US005669398A

United States Patent [19]

Dadgostar

[11] Patent Number: 5,669,398

[45] Date of Patent: Sep. 23, 1997

[54] HAIR STYLING TOOL AND METHOD OF USE

[75] Inventor: Yassaman A. Dadgostar, Camarillo, Calif.

[73] Assignees: Yassaman Dadgostar; Houshang Dadgostar, both of Camarillo, Calif.

[21] Appl. No.: 606,452

[22] Filed: Feb. 23, 1996

[51] Int. Cl.[6] ..... A45D 7/00; A45D 2/18

[52] U.S. Cl. ..... 132/210; 132/247; 132/245

[58] Field of Search ..... 132/210, 246, 132/247, 237, 265, 270, 245

[56] References Cited

U.S. PATENT DOCUMENTS

| | | | |
|---|---|---|---|
| 789,686 | 5/1905 | Dunlap | 132/247 |
| 3,108,603 | 10/1963 | Mobberley | 132/237 |
| 3,861,405 | 1/1975 | Pellecchia | 132/270 |

FOREIGN PATENT DOCUMENTS

| | | | |
|---|---|---|---|
| 535582 | 4/1922 | France | 132/245 |
| 748313 | 7/1933 | France | 132/245 |

*Primary Examiner*—Todd E. Manahan
*Attorney, Agent, or Firm*—Gene W. Arant

[57] ABSTRACT

A hair styling method utilizes an elongated flexible mold member having hollow end portions, two elongated rigid handle members each more than half the length of the mold member, with each of the elongated rigid handle members having an inner end portion and an outer handle end. The inner end portion of each of the elongated rigid handle members is inserted into a corresponding end portion of the mold member so that the elongated flexible mold member may then be bent into a generally U-shaped configuration and the handle ends of the elongated rigid handle members then occupy a generally parallel relationship in close proximity to each other. The outer handle ends of the elongated handle members have an interfitting relationship so that they may be placed in that interfitting relationship and thereby draw the outer end portions of the flexible mold towards each other.

8 Claims, 2 Drawing Sheets

24
35
34
28
26
36
38
20
30
22
32
10
12
14
16

3
4

18

19

HAIR STYLING TOOL AND METHOD OF USE

FIELD OF THE INVENTION

The present invention relates to the preparation of ladies' hair styles, and apparatus useful in connection therewith.

1. Background of the Invention

Selecting and preparing a lady's hair style is a sophisticated art, not only in the United States but throughout the world. Much time, effort and expense are devoted to designing hair styles, the preparation of selected hair styles upon the heads of particular ladies who are going to wear them, selection of clothing and jewelry to accompany particular hair styles, admiration and criticism of hair styles when exposed to view, and merchandising various tools and accessories that are used in preparing the hair styles. This field of industry is of significant proportions.

When a particular hair style is desired by a particular lady, one question arises as to whether she can prepare the style herself, or must have the assistance of another person, usually a paid hair stylist. Another question arises as to the particular type of tools or accessories, if any, that are required to expedite that process. A further question is how much time and expense are required to accomplish the process, including the cost of the tools and accessories and/or the expense of the stylist.

2. Prior Art

It is quite old in the art for ladies to employ pins or other devices that are inserted into the hair for purpose of holding it in place, which devices are then covered and obscured by the hair.

U.S. Pat. No. 5,303,723 discloses a hair styling device that is particularly useful for a lady's own preparation of a hair style. The device disclosed there is of a generally peanut-shaped configuration, having an outer covering of material that is capable of clinging to the hair, and providing a relatively narrow waist portion adapted to receive and hold a mass of hair. The interior base portion of the device is deformable and capable of being repeatedly bent to form the device into a variety of shapes, so that the device may be bent into one configuration for one type of hair style and then later re-used in a different configuration for another type of hair style. When each hair style is being prepared, the hair is arranged to enclose and cover up the hair styling device.

SUMMARY OF THE INVENTION

The present invention provides a method and apparatus for the styling of hair with a twist, such, as for example, the well known French twist. The method of the present invention utilizes an elongated flexible mold member having hollow end portions, and two elongated rigid handle members each of which is more than half the length of the mold member. Each of the elongated rigid handle members has an outer end portion or handle end, and also has an inner end portion which is insertable into a corresponding hollow end portion of the mold member.

To accomplish the hair styling, the inner end portions of the elongated rigid handle members are inserted into corresponding hollow end portions of the flexible mold member, a portion of hair is drawn over the flexible mold member, and the mold member is then bent into a generally U-shaped configuration so that the hair is captured within it. The handle ends of the handle members, which are then generally parallel, and are twisted or rotated to wind the hair about the mold. Fasteners are then inserted into the thus-wound hair to hold it in place relative to the mold member, and then the handle members are withdrawn.

DRAWING SUMMARY

DETAILED DESCRIPTION

(FIGS. 1–9)

Figures 1, 2, 3, 4:
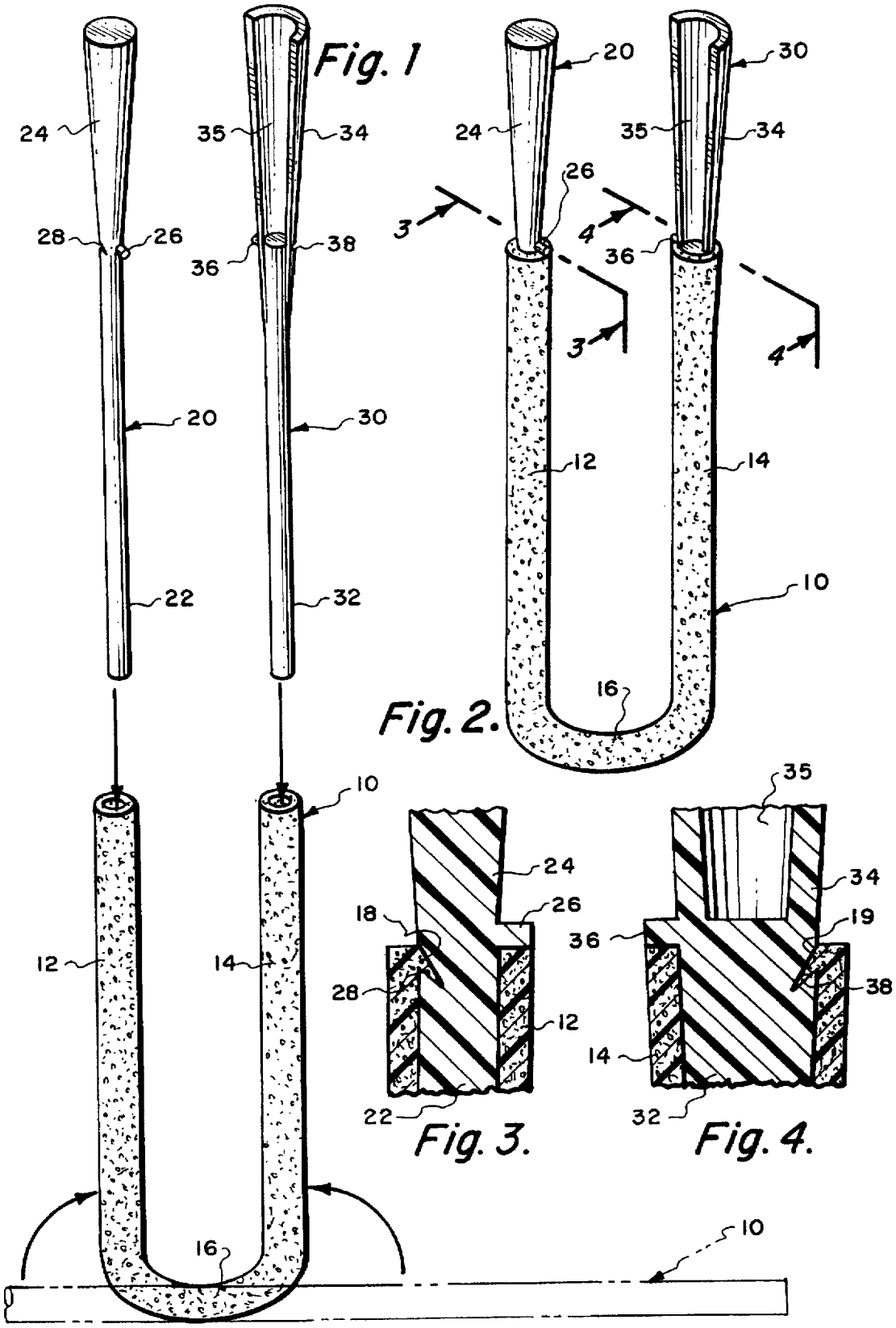
FIG. 1 is a perspective view of my novel hair styling tool in disassembled form.
FIG. 2 is a perspective view of the tool when assembled.
FIG. 3 is a fragmentary cross-sectional view taken on the line 3—3 of FIG. 2.
FIG. 4 is a fragmentary cross-sectional view taken on the line 4—4 of FIG. 2.

As shown in the drawings, my novel hair styling device includes an elongated flexible mold member 10 having hollow end portions 12, 14, the elongated flexible mold member having an outer surface capable of clinging to hair and preferably being made from a resilient material such as polyurethane ester foam. The portion 16 at the longitudinal center of mold member 10 may be a solid member, but may also be hollow if so desired.

Two elongated rigid handle members 20, 30, are provided, each being more than half the length of the mold member 10. The handle members are preferably made of a rigid plastic material with a slick surface. Each of the elongated handle members has an inner end portion and an outer handle end, the inner end portion of handle member 20 being designated as 22 while the inner end portion of handle member 30 is designated as 32. The inner end portions 22, 32, of the handle members are preferably about twice the length of the respective outer end portions.

The outer end portion 24 of handle member 20 is tapered to its largest diameter at its outer extremity, and is preferably a solid member in order to interfit with the other handle member. The outer end portion 34 providing a handle for the handle member 30 is also tapered to its largest diameter at its outer extremity, but is preferably hollow in order to receive the handle portion 24 of handle member 20. Each of the handle members 20, 30, is more than half the length of the mold member, for proper functioning of the apparatus.

As shown in FIGS. 1 and 2 the inner end portion 22 of handle member 20 is insertable into the corresponding end portion 12 of mold member 10, and the inner end portion 32 of handle member 30 is insertable into the corresponding end portion 14 of mold member 10. For this purpose the extremities are preferably rounded and provided with a slick surface.

In accordance with the novel method of my invention, the inner end portions 22, 32, of the handle members 20, 30, are inserted into the corresponding hollow end portions 12, 14, of the flexible mold member 10. At this time it is preferred to releasably secure each of the handle members in a predetermined longitudinal relationship to the associated end portion of the flexible mold member. For that purpose the handle member 20 has a stop member 26 protruding laterally from it at the upper extremity of its inner end, and also has a notch 28 formed in its side opposite the stop member 26. As shown in FIG. 3, the stop member 26 limits the distance by which the inner end portion 22 of the handle member 20 may penetrate into the hollow end portion 12 of mold member 10. At the same time, a locking loop 18 that is provided on the end of mold portion 22 locks into the notch 28 of the handle member. Handle member 30 is similarly supported in a releasable position relative to mold portion 14 by means of stop member 36, notch 38, and locking loop 19, all as shown in FIG. 3.

Figure 5:
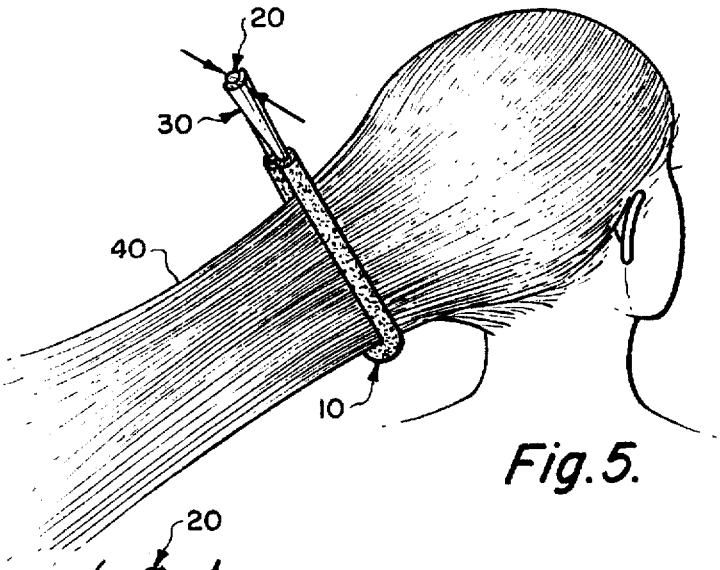
FIG. 5 is a perspective view of my novel hair styling tool in assembled form with the hair of a subject passing through it.

Although in the drawings the handle members 20, 30, are shown in generally parallel relationship, it should be understood that it is preferred to align them into a substantially linear relationship while their end portions are being inserted into the hollow end portions of the mold member. Then, as shown in FIG. 5, a quantity of hair 40 is drawn over the flexible mold member 10. The mold member is then bent into a generally U-shaped configuration so that the quantity of hair is then captured within the mold member and between the inner portions 22, 32, of the handle members.

Figure 6:
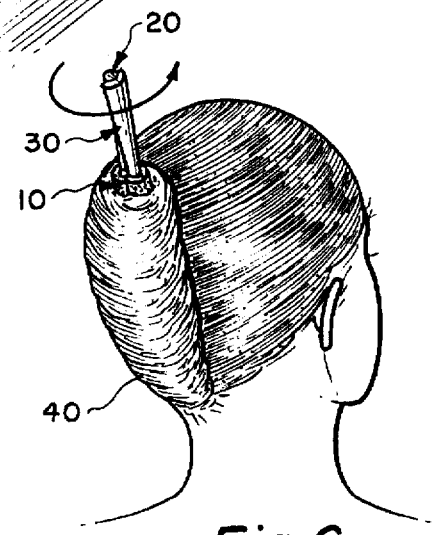
FIG. 6 is a perspective view showing the position of the hair after it has been wound about the mold of my styling tool.

Next, handle members 20, 30, and the mold member 10 are rotated in synchronism so as to twist the hair about the mold member, as indicated in FIG. 6. The rotation or twisting action is accomplished relative to the vertical longitudinal axis of the U-shaped mold member.

Before accomplishing this rotating or twisting action it is preferred to bend the handle portions of the two handle members toward each other, so that the solid handle portion 24 of handle member 20 may be received within the hollow handle portion 34 of handle member 30. As shown in FIG. 1, the handle portion 34 is hollowed at 35 for this purpose. The two handle portions may then be conveniently clamped together, as shown by arrows in FIG. 5, using only one of a person's hands.

Figure 8:
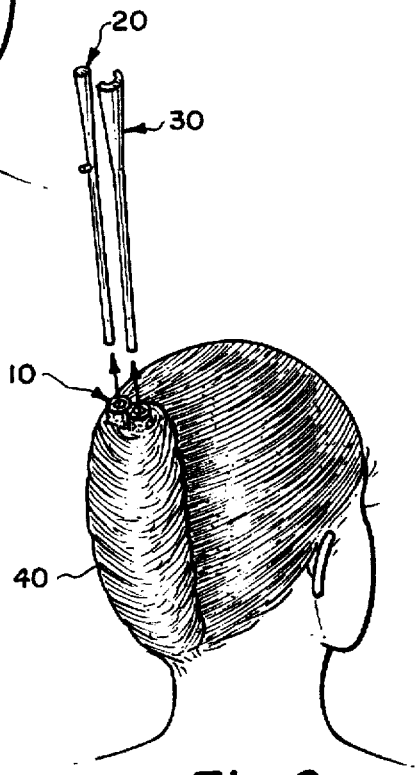
FIG. 8 is a perspective view like FIGS. 6 and 7, but showing the handle members of my tool after removal from the mold.
Figure 7:
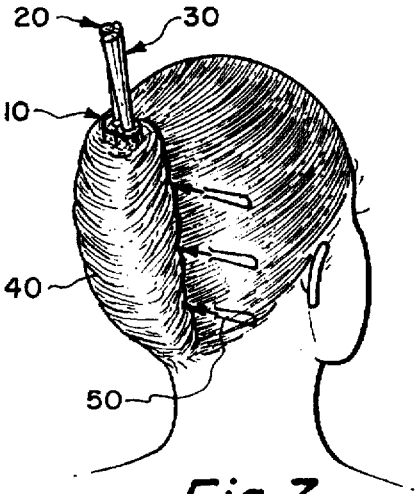
FIG. 7 is a perspective view like FIG. 6, showing pins ready to be inserted into the hair.
Figure 9:
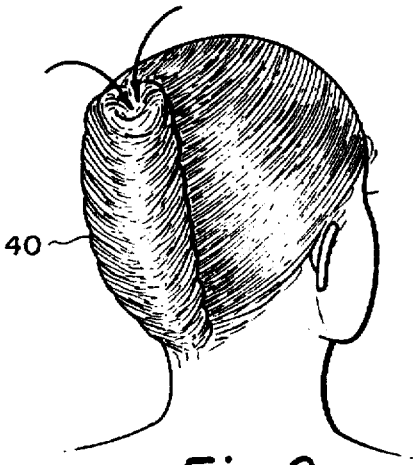
FIG. 9 is a perspective view showing portions of the subject's hair having been adjusted to cover the ends of the mold.

The next step is to insert pins or other fasteners into the thus-twisted hair so as to secure its position relative to the mold member, as shown by pins 50 in FIG. 7. The handle members may then be withdrawn vertically from the ends of the mold member, as shown in FIG. 8. Thereafter a portion of hair is slid over the upper end of the mold member as shown in FIG. 9 so as to hide it from view.

One advantage of the invention is that a do-it-yourself operation is quite convenient, thereby saving both time and money for the lady desiring to have the French twist or similar style.

Another advantage is that the mold member, being made of a plastic type of material, will easily pass through metal detectors at airports and the like, thus creating no inconvenience or delay.

While the presently preferred form of the invention has been disclosed in detail in order to comply with the patent laws, it will be understood that the scope of the invention is to be measured only in accordance with the appended claims.

What I claim is:

1. A method of styling hair, comprising the steps of:

(a) selecting an elongated flexible mold member having hollow end portions;

(b) selecting two elongated rigid handle members each being more than half the length of the mold member, each of the elongated handle members having an inner end portion which is insertable into a corresponding end portion of the mold member and also having an outer end portion providing a handle;

(c) inserting the inner end portions of the handle members into corresponding hollow end portions of the flexible mold member;

(d) drawing a quantity of hair over the flexible mold member;

(e) bending the elongated flexible mold member into a generally U-shaped configuration so that the quantity of hair is then captured within the mold member;

(f) rotating the handle members and mold member in synchronism so as to twist the hair about the mold member;

(g) inserting fasteners into the thus-twisted hair so as to secure its position relative to the mold member; and (h) then withdrawing the handle members from the ends of the mold member.

2. The method of claim 1 wherein, after the mold member is bent, the outer end portions of the elongated handle members are maintained in generally parallel relationship by grasping them with one hand.

3. The method of claim 1 which includes the further step, after the inner end portions of the elongated handle members are inserted into the corresponding hollow end portions of the flexible mold member, of releasably securing them in a predetermined longitudinal relationship to the associated end portions of the flexible mold member.

4. The method of claim 3 wherein the outer end portions of the elongated handle members are selected to have an interfitting relationship, and which includes the further step of placing the outer end portions of the elongated handle members in that interfitting relationship so as to draw the outer end portions of the flexible mold towards each other.

5. The method of claim 1 wherein the outer end portions of the elongated handle members are selected to have an interfitting relationship, and which includes the further step of placing the outer end portions of the elongated handle members in that interfitting relationship so as to draw the outer end portions of the flexible mold towards each other.

6. A hair styling device comprising:

an elongated flexible mold member having hollow end portions;

two elongated rigid handle members each being more than half the length of the mold member, each of the elongated rigid handle members having an inner end portion and an outer handle end;

the inner end portion of each of the elongated rigid handle members being insertable into a corresponding end portion of the mold member so that the elongated flexible mold member may then be bent into a generally U-shaped configuration and the handle ends of the elongated rigid handle members will then occupy a generally parallel relationship in close proximity to each other; and wherein the outer handle ends of the elongated handle members have an interfitting relationship, so that they may be placed in that interfitting relationship and thereby draw the outer end portions of the flexible mold towards each other.

7. A hair styling device, comprising:

an elongated flexible mold member having hollow end portions;

two elongated rigid handle members each being more than half the length of said mold member, each of said elongated rigid handle members having an inner end portion and an outer handle end;

the inner end portion of each of said elongated rigid handle members being insertable into a corresponding end portion of said mold member so that said elongated flexible mold member may then be bent into a generally U-shaped configuration and said handle ends of said elongated rigid handle members will then occupy a generally parallel relationship in close proximity to each other;

each of the elongated rigid handle members adjacent its inner end portion including means cooperable with the corresponding hollow end portion of the flexible mold member when it is inserted therein for releasably securing it thereto in a predetermined longitudinal relationship; and the outer handle ends of the handle members being tapered to their largest diameter at their outer extremities, and the outer handle ends of the elongated handle members having an interfitting relationship such that they may be placed in that interfitting relationship to draw the outer end portions of the flexible mold together.

8. A hair styling device as in claim 7 wherein the elongated flexible mold member is made of a polyurethane ester foam and has an outer surface capable of clinging to hair.

* * * * *